US006807690B1

(12) United States Patent
Satterfield

(10) Patent No.: US 6,807,690 B1
(45) Date of Patent: Oct. 26, 2004

(54) ASSISTED LIFT SHOWER SEAT

(76) Inventor: Steven Ray Satterfield, P.O. Box 308, Durant, OK (US) 74701

( * ) Notice: Subject to any disclaimer, the term of this patent is extended or adjusted under 35 U.S.C. 154(b) by 0 days.

(21) Appl. No.: 10/449,635

(22) Filed: May 30, 2003

Related U.S. Application Data

(60) Provisional application No. 60/413,243, filed on Sep. 24, 2002.

(51) Int. Cl.[7] ..... A47K 3/022

(52) U.S. Cl. ..... 4/578.1; 297/14; 297/332

(58) Field of Search ..... 4/578.1, 579, 590, 4/611, 483; 297/14, 331, 332, 333; 182/187, 188

(56) References Cited

U.S. PATENT DOCUMENTS

| | | | | | |
|---|---|---|---|---|---|
| 970,777 | A | * | 9/1910 | Ackerman | 4/578.1 |
| 4,087,127 | A | * | 5/1978 | Lotta | 4/578.1 |
| 4,113,058 | A | * | 9/1978 | Kobosh | 182/187 |
| 4,460,215 | A | * | 7/1984 | Chamberlain et al. | 297/14 |
| 5,185,892 | A | | 2/1993 | Mitchell | |
| D342,779 | S | | 12/1993 | Root | |
| D411,065 | S | | 6/1999 | Davis | |
| 5,967,255 | A | | 10/1999 | Young | |
| 6,067,671 | A | | 5/2000 | Ginder | |
| 6,089,651 | A | | 7/2000 | Carmen | |
| 6,305,741 | B1 | | 10/2001 | Fernandez | |
| D464,818 | S | | 10/2002 | Adman | |

OTHER PUBLICATIONS

Catalogue : Seachrome Shower Seats www.seachrome.com/stlseat.html.

* cited by examiner

*Primary Examiner*—Gene Mancene
*Assistant Examiner*—Khoa Huynh
(74) *Attorney, Agent, or Firm*—Randal D. Homburg

(57) ABSTRACT

An assisted lift shower seat seeking strict compliance with applicable ADA standards includes a wall mounted pivotal shower seat having a frame attached to the wall in a shower by at least two brackets, the shower seat pivotally raised and lowered with the assistance of a stiff torsion spring anchored to the bracket and applying force to the shower seat, diminishing the force required to raise and lower the shower seat from a vertical to horizontal and horizontal to vertical position.

2 Claims, 9 Drawing Sheets

ASSISTED LIFT SHOWER SEAT

CROSS REFERENCE TO RELATED APPLICATIONS

Claim is made to Provisional Patent No. 60/413,243, filed on Sep. 24, 2002.

I. BACKGROUND OF THE INVENTION

1. Field of Invention

An assisted lift shower seat seeking strict compliance with applicable ADA standards includes a wall mounted pivotal shower seat having a frame attached to the wall in a shower by at least two brackets, the shower seat pivotally raised and lowered with the assistance of a stiff torsion spring anchored to the bracket and applying force to the shower seat, diminishing the force required to raise and lower the shower seat from a vertical to horizontal and horizontal to vertical position.

2. Description of Prior Art

The following United States patents were discovered and are disclosed within this application for utility patent. All relate to shower seats of some form and fashion.

Three design patents are disclosed in U.S. Pat. Nos. D464,818 to Adman, D411,065 to Davis and D342,779 to Root, adapted to be attached to a wall or vertical surface, with Root being referenced as a shower seat. All appear to require manual lifting and raising without spring assistance. They also bear little aesthetic similarity to the present shower seat.

Three other seats are shown in U.S. Pat. Nos. 6,305,741 to Fernandez, 6,089,651 to Carmen and 5,967,255 to Young that have attachment to a vertical wall, with Fernandez and Young having a double hinged folding means allowing for the folding of the chair against a wall, with the seat folding to a horizontal position and legs or a leg panel folding into a vertical position to support the seat to the floor of the shower or bath. These do not have a spring lift assist mechanism or means. Carmen is a folding chair attached to a wall with a sliding bracket to hold the upper portion of the chair against the wall in either a raised or lowered position, the seat pivoting up or down as the chair back is raised or lowered. No spring means or lift assist is disclosed. In addition, these seats require unfolding which may pinch the seated person, or collapse if the leg support folds or slides.

In U.S. Pat. No. 5,185,892 to Mitchell, a bath and shower seats without lift assist means is shown, attaching to the wall and pivoting on the edge of the tub with the seat folding from the wall. It has a pivotal leg brace that requires unfolding before the seat is secured into a horizontal position. U.S. Pat. No. 6,067,671 is an example of a shower seat that is not a folding variety, but is set in a shower and anchored with extending support rods to the walls to prevent movement of the seat in the shower. A whole series of shower seats is also found in a catalogue published by Seachrome Corporation in Azusa, Calif., the catalogue downloaded from that companies web site at www.seachorome.com.

None of these prior art patents appear to meet or even seek the standards of compliance of ADA §4.27.4 which states as follows:

> "4.27.4 Operation. Controls and operating mechanisms shall be operable with one hand and shall not require tight grasping, pinching, or twisting of the wrist. The force required to activate controls shall be no greater than 51 bf (22.2 N)."

The present invention, by inclusion of the spring assist torsion spring engaging the seat requires less than the maximum amount of force to raise and lower the seat provided the torsion spring is matched to the weight of the seat, the present shower seat easily raised and lowered with the force applied by one finger. Setup can be accomplished with one hand, since no folding parts require the use of a second hand, and raising and lowering of the seat causes no pinching, tight grasping or twisting of the wrist.

II. SUMMARY OF THE INVENTION

Since enactment of the Americans with Disabilities Act manufacturers of accessories for persons with disability have been attempting to make products that not only accommodate the disabled, but also meet compliance with guidelines consistent with the ADA and practical application. Shower seats, in particular, are used by persons with disabilities including amputees, stroke patients, orthopaedic patients, heart patients, and those with progressive diseases affecting the neuromuscular systems require some scating device in the shower, unable to get in or out of a bathtub, yet unable to stand for a shower. Often is the case that catastrophic injury can occur when those with disability attempt to shower without assistance fall or slip in the shower.

As demonstrated in prior art, shower seats themselves are not new, nor are seats attaching to the wall. However, those prior art seats either require one to lift the entire weight of the seat from a closed position to open, or from an open position to closed, without weighted assistance. They also have parts that require more than one hand to establish the seat in the open position, or they require one to bend over to set the legs to support the shower seat.

The primary objective of the invention is to provide a secured folding shower seat which is "operable with one hand and shall not require tight grasping, pinching, or twisting of the wrist," with a "force required to activate controls shall be no greater than 5 lbf (22.2 N)" to raise and lower the seat.

A second objective of the invention is to provide the shower seat is different embodiments with consideration given to the shape of the existing shower or the new shower within which the shower seat is installed. This second objective is accomplished by the orientation of the framework under the seat, the selection of a wall mounting bracket suited for the various installation requirements, and the size and connection of the torsion spring.

III. DESCRIPTION OF THE DRAWINGS

The following drawings are submitted with this utility patent application.

Figure 3A:
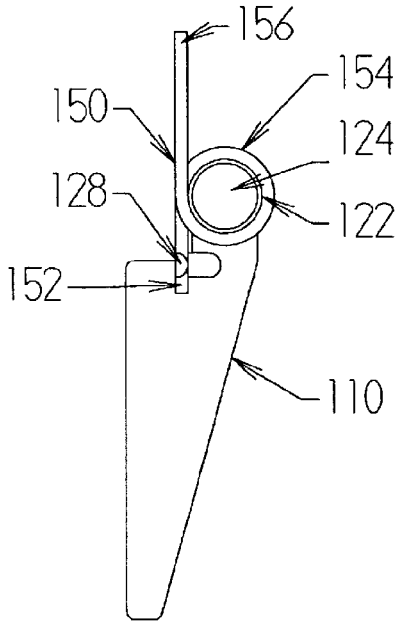

FIG. 3*a* is a side view of the wall mounting bracket for the first embodiment shower seat.

Figure 3B:
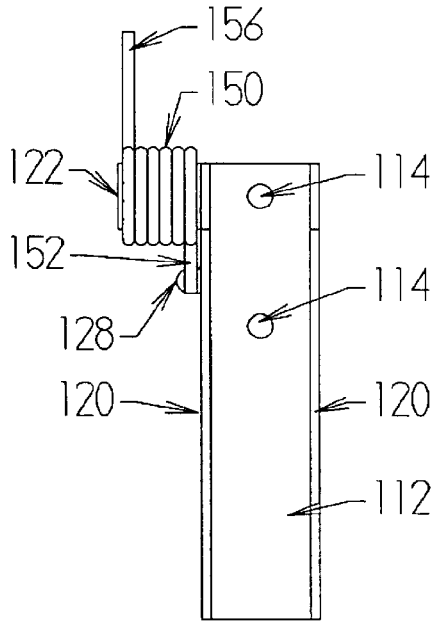
Figure 4:
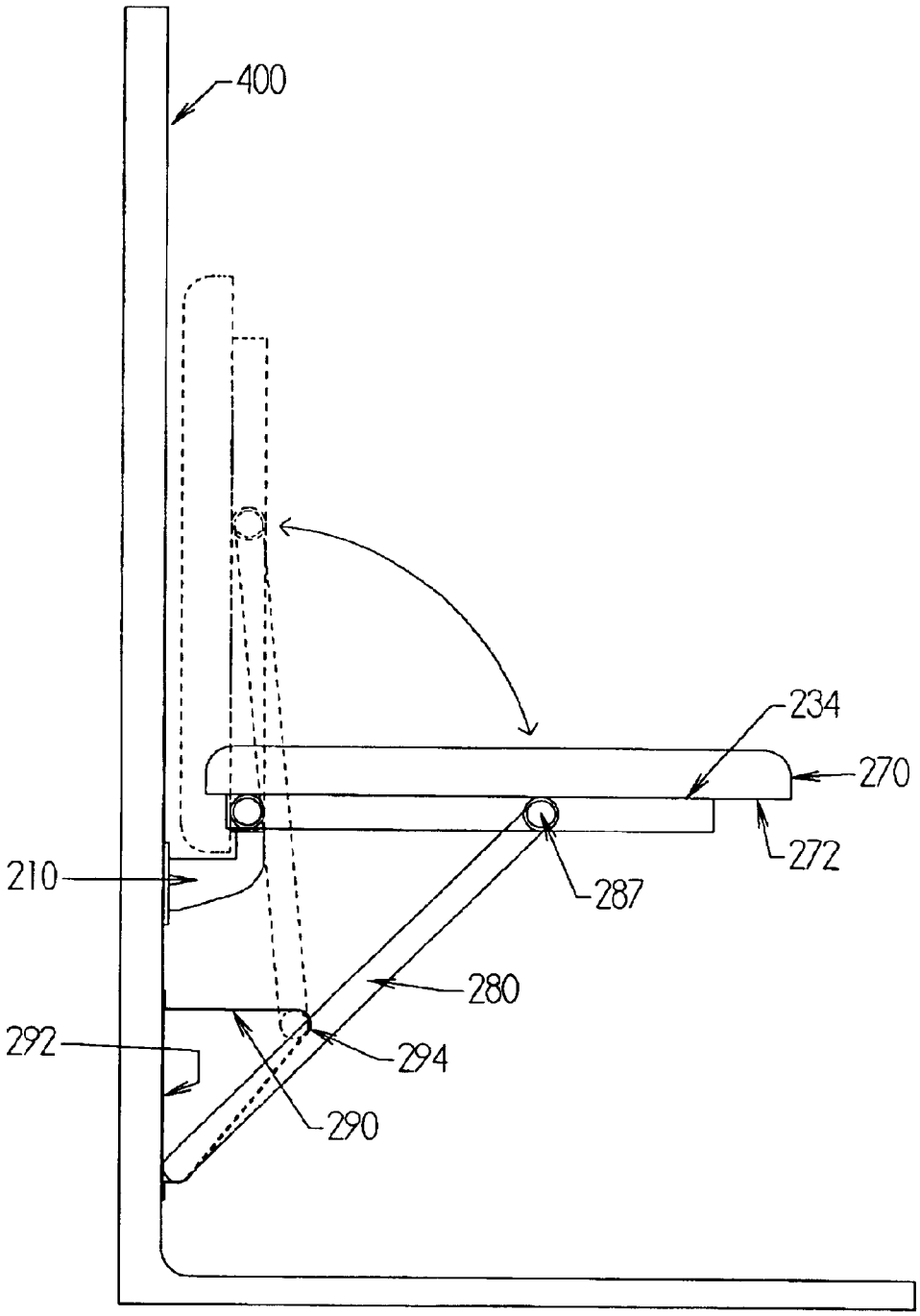

FIG. 3*b* is a front view of the wall mounting bracket for the first embodiment shower seat FIG. 4 is a side view of a second embodiment of the lift assist shower seat.

Figure 5:
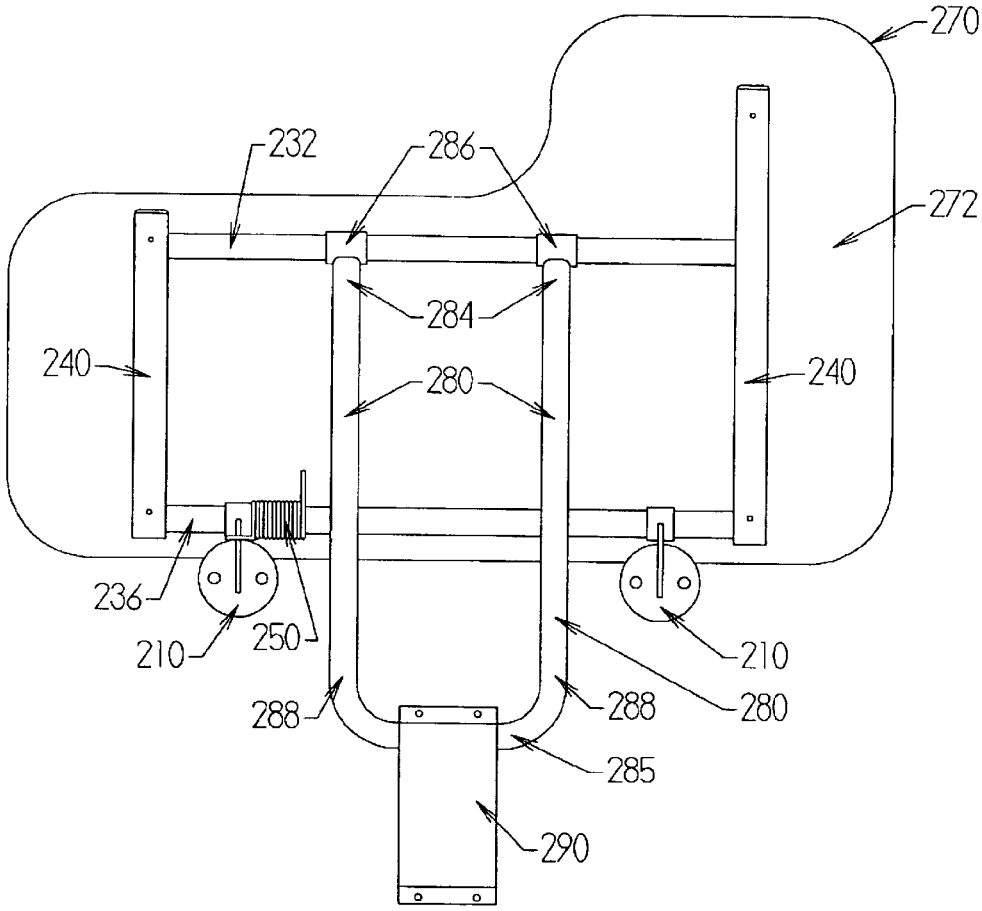

FIG. 5 is a bottom view of the second embodiment shower seat in a raised position.

Figure 6A:
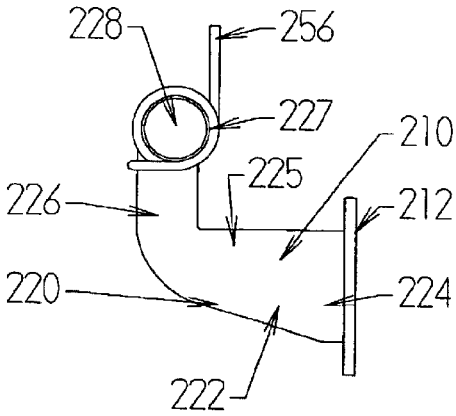

FIG. 6*a* is a side view of the wall mounting bracket for the second embodiment shower seat.

Figure 6B:
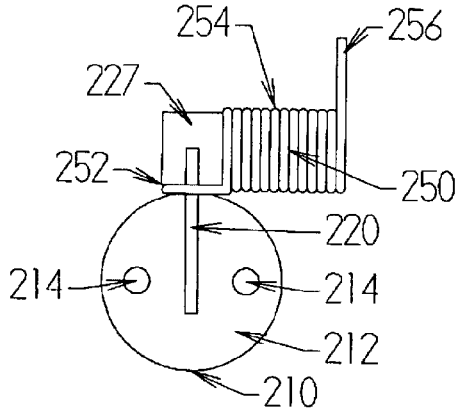

FIG. 6*b* is a front view of the wall mounting bracket for the second embodiment shower seat.

Figure 7:
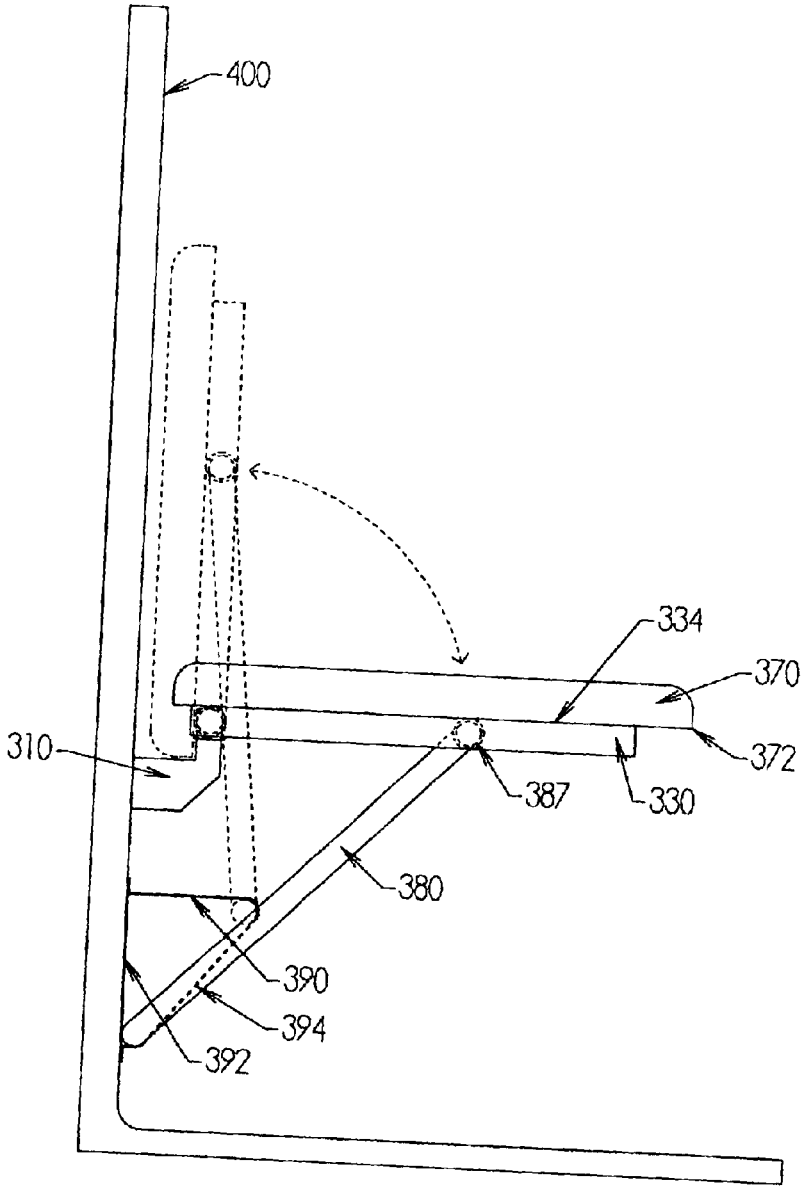

FIG. 7 is a side view of a third embodiment of the lift assist shower seat.

Figure 8:
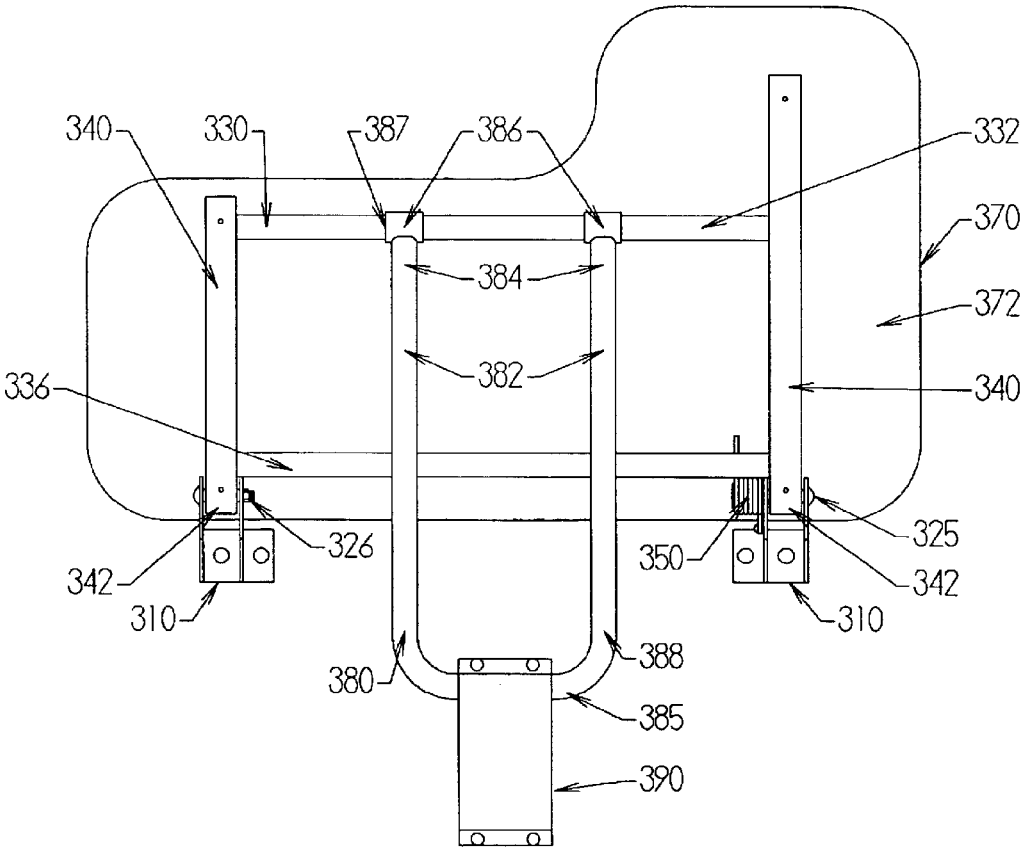

FIG. 8 is a bottom view of the third embodiment shower seat in a raised position.

Figure 9A:
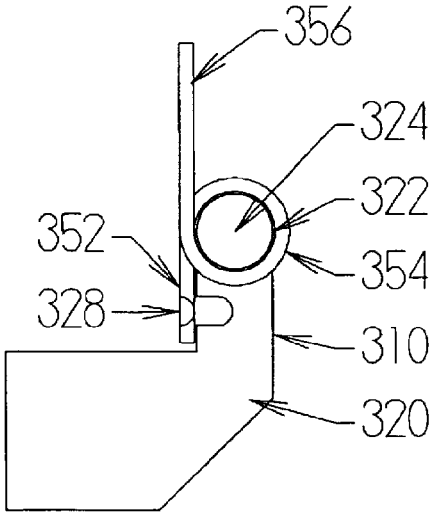
Figure 9B:
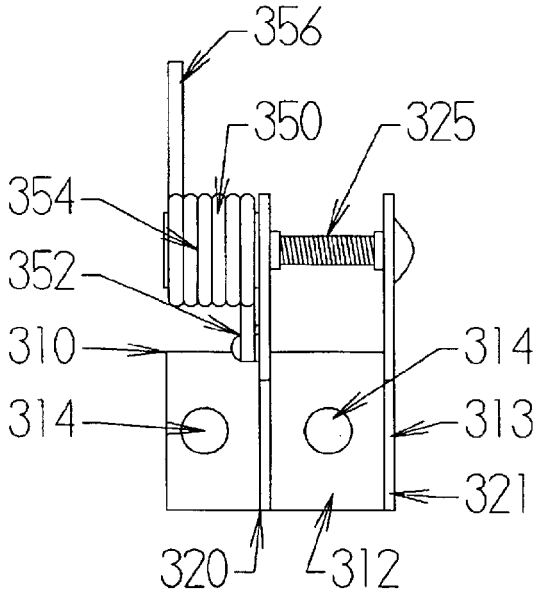

FIG. 9*a* is a side view of the wall mounting bracket for the third embodiment shower seat FIG. 9*b* is a front view of the wall mounting bracket for the third embodiment shower seat.

IV. DESCRIPTION OF THE PREFERRED EMBODIMENT

A shower seat attached to a wall of a shower or bath for persons requiring seating during bathing or shower having a torsion spring to raise and lower the shower seat between a vertical and horizontal position, shown in FIGS. 1–9*b* of the drawings, comprises essentially two wall mounting brackets 110, 220, 310 pivotally attaching to a support frame 130, 230, 330, the wall mounting brackets secured to at least one torsion spring 150, 250, 350, the torsion spring applying an upward urging force against a rigid water impermeable seat portion 170, 270, 370 mounted to the support frame, the wall mounting brackets secured to a shower wall 400 by at least four lag screws. The seat portion 170, 270, 370, support frame 130, 230, 330, wall mounting brackets 110, 210, 310 and torsion spring 150, 250, 350 are of varied size, shape, strength and tension depending on the size of the shower, with the torsion spring providing assistance to lower the amount of force required to raise and lower the seat portion below 5 lbf. The support frame 130, 230, 330, wall mounting brackets 110, 210, 310 and torsion spring 150, 250, 350 are preferably made of a strong noncorrosive metal product, including stainless steel and aluminum.

Figure 1:
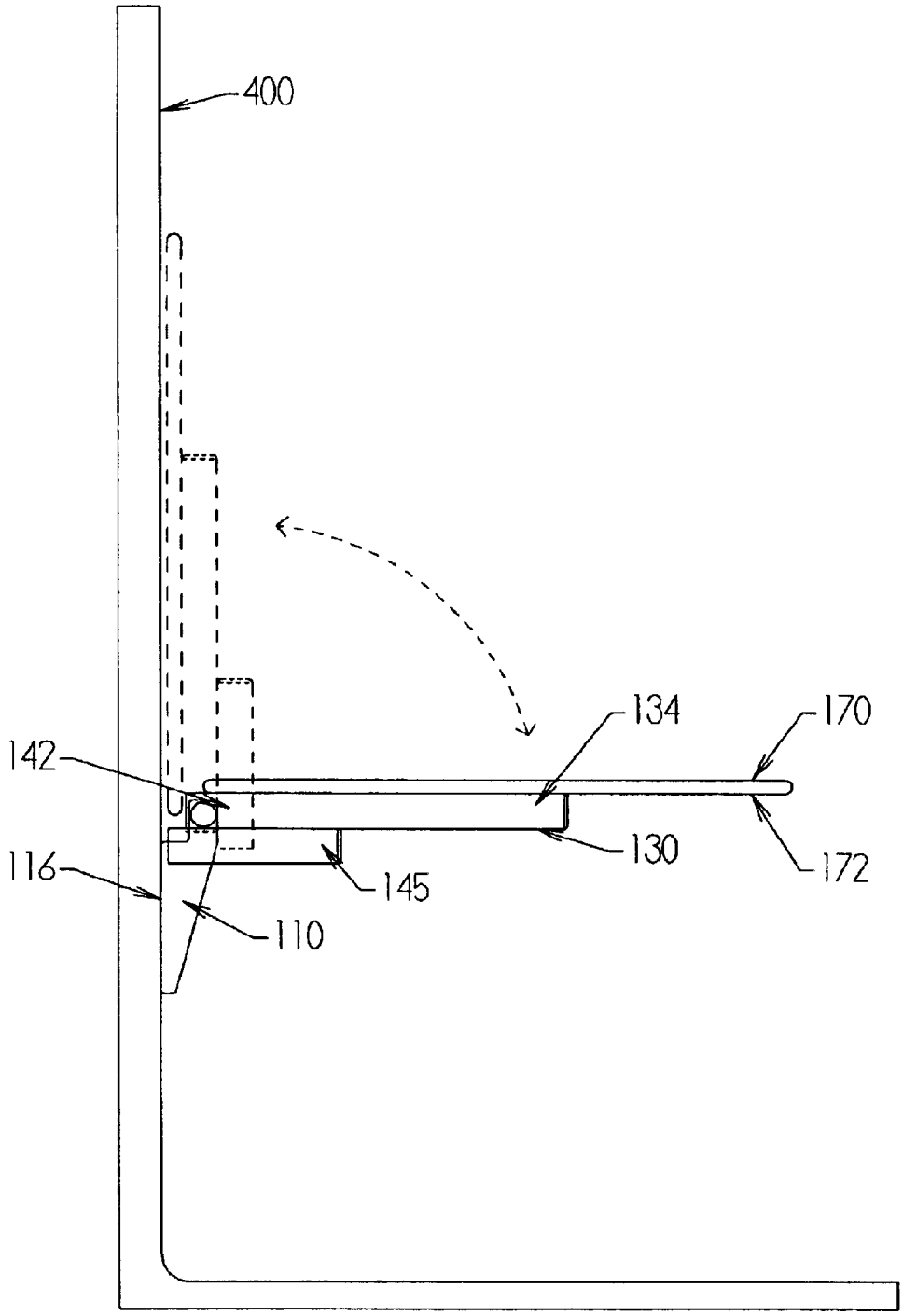
FIG. 1 is a side view of a first embodiment of the lift assist shower seat.

The shower seat is provided in at least three different embodiments, each embodiment adapted to different installation requirements and choice by the user. The first embodiment, shown in FIGS. 1–3*b*, is pivotally mounted to the shower wall 400 as shown in FIG. 1, and further comprises two wall mounting brackets 110, shown in FIGS. 3*a* and 3*b*, a support frame 130, shown in FIGS. 1 and 2, pivotally attached to the wall mounting brackets 110, a torsion spring 150, applying a bias force between the wall mounting bracket 110 and a shaped seat portion 170, the seat portion 170 attached to the support frame 130, with the wall mounting brackets 110 attached to the shower wall 400 by the at least four lag screws.

The wall mounting brackets 110 have a central plate 112 with a flat rear surface 116 placed against the shower wall 400, two side support plates 120 extending from the central plate 110, with one of the side support plates 120 having a tubular cylindrical side extension 122 defining a central channel 124, upon which the torsion spring 150 is affixed. Pivot holes are placed through each side support plate 120, aligned with the central channel 124, allowing for the insertion of a threaded bolt 125 and lock nut 126 to connect the support frame 130 to the wall mounting bracket 110. The torsion spring 150 includes an anchor leg 152 extending from a central coil 154, and an extension leg 156. The central coil 154 is positioned to wrap around the side extension 122, with the anchor leg 152 extending downward and the extension leg 156 extending upward. An anchor peg 128 is located on the side support plate 120 upon which the side extension 122 is located, engaging the anchor leg 152 to arrest movement of the anchor leg 152 towards the shower wall 400 when the wall mounting bracket 110 is secured to the shower wall 400 and to secure and hold the torsion spring 150 upon the side extension 122. The central plate 112 of each of the wall mounting brackets 110, shown in FIG. 3*b*, has two vertically aligned holes 114, each hole 114 accepting a lag screw to attach the wall mounting bracket 110 to the shower wall 400, preferably into a wall stud.

Figure 2:
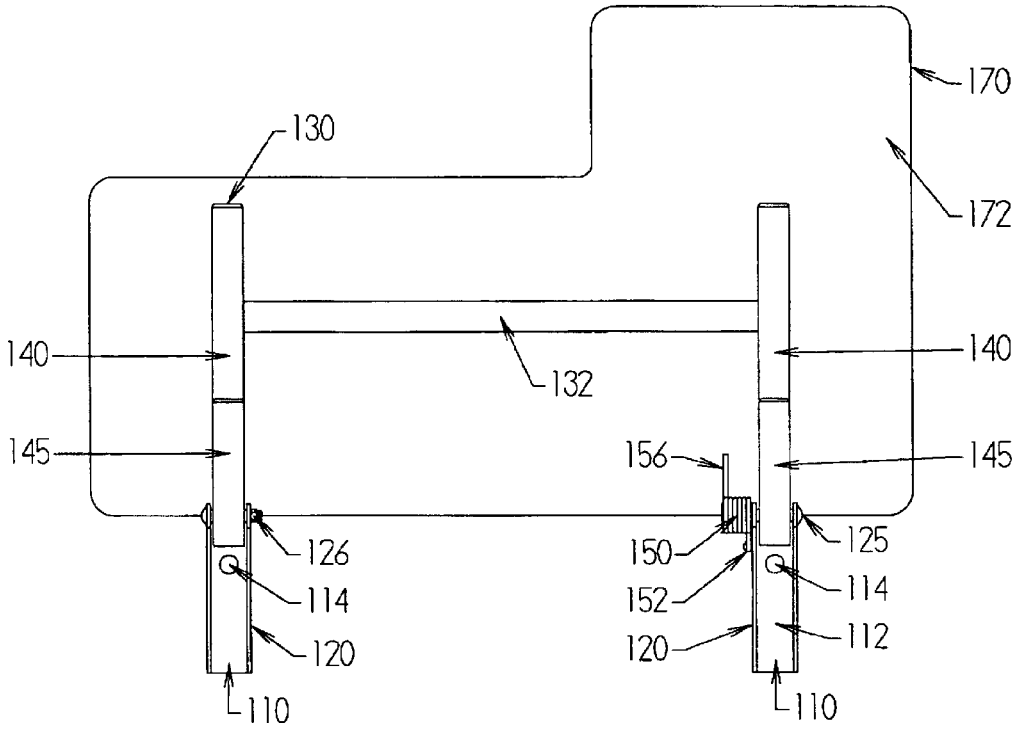
FIG. 2 is a bottom view of the first embodiment shower seat in a raised position.

The support frame 130 is most preferably a rigid frame having the shape of the letter "H", shown in FIG. 2, including two side brackets 140 and a cross connecting bracket 132. The side brackets 140 include extension arms 142 having vertically oriented holes through which the threaded bolts 125 may extend, the extension arms 142 captured between the side support plates 120. The support frame 130 further provides lower block legs 145 which rest against the central plate 112 of the wall mounting bracket 110 when the attached seat portion 170 is lowered to a horizontal position, preventing further downward movement of the seat portion 170.

The seat portion 170 is a rigid water impermeable material attached to an upper surface 134 of the support frame 130. The seat portion 170 is attached to the support frame 130 in a manner not to impede the raising or lowering of the shower seat, also allowing the seat portion 170 to rest flush against the shower wall 400 in a raised position. The seat portion 170 may include padding for the comfort of the user, and may also include holes to allow water to drain through the seat portion during and after bathing.

The torsion spring 150 is biased between the anchor peg 128 on the side support plate 120 and a lower surface 172 of the seat portion 170. This torsion spring 150 provides an upward force to assist in raising the shower seat, and also provides a downward resistance when lowering the shower seat. This torsion spring 150 should be of sufficient tension as to reduce the amount of force required to raise and lower the shower seat at less than 5 lbf, or 22 N.

A second embodiment of the shower seat, shown in FIGS. 4–6*b*, includes two wall mounting brackets 210, a torsion spring 250, a support frame 230 connected to a seat portion 270, the support frame 230 pivotally attached to the wall mounting brackets 210, while the torsion spring 250 applies a bias force between the wall mounting bracket 210 and the seat portion 270. The second embodiment of the shower seat also includes a pivotal secondary support brace 280, pivotally connected to the support frame 230, the secondary support brace 280 slidably engaging a support leg bracket 290, also mounted to the shower wall 400 below the wall mounting brackets 210.

In this second embodiment the wall mounting brackets 210, shown in FIGS. 6*a* and 6*b*, include a back plate 212 having two holes 214 in horizontal alignment, each hole 214 accepting a lag screw to attach the back plate 212 of each wall mounting bracket 210 to the shower wall 400, preferably into a wall stud. The holes 214 of this embodiment are placed in this horizontal alignment to allow for all four lag bolts anchoring the wall mounting brackets to hold a more equivalent weight than would four lag screws in a vertical alignment, as indicated in the first embodiment. An L-bracket 220 extends from the back plate 212, the L-bracket 220 having a horizontal arm 222 with a first end 224 welded to the back plate 212 between the two holes 214. A vertical arm 226 extends upward from a second end 225 of the horizontal arm 222 of the L-bracket 220, terminating in a vertically oriented tubular extension 227 having a central channel 228, upon which the torsion spring 250 is affixed. Most preferably, the L-shaped bracket 222 is made of a single piece of strong flat metal.

The torsion spring 250 of the second embodiment comprises a curled anchor leg 252 extending from a central coil 254, and an extension leg 256. The central coil 254 is placed onto the tubular extension 227, with the curled anchor leg 252 extending downward, wrapped around the vertical arm 226 of the L-bracket 220, and the extension leg 256 extending upward, resting against the seat portion 270, as indicated in FIGS. 5–6*b* of the drawings.

The support frame 230 of the second embodiment includes two side brackets 240 connected together by a front cross connecting bracket 232 and a rear cross connecting bracket 236, in a rectangular shape, as shown in FIG. 5 of the drawings. The rear cross connecting bracket 236 is passed through the central channel 228 of the tubular extensions 227 on the two wall mounting brackets 210 in pivotal engagement. The secondary support brace 280 is U-shaped, with two legs 282 having a first end 284 connecting to a perpendicular tubular portion 286 having a transverse channel 287, and a second end 288 connected to a base portion 285. Ideally, this secondary support brace 280 is a single piece of bent metal with the tubular portion 286 welded onto the first ends 284. The front cross connecting bracket 232 is engaged within the tubular portions 286 of the secondary support brace 280. The support leg bracket 290, indicated in FIG. 4, also mounted to the shower wall 400 below the wall mounting brackets 210, is a triangular projecting bracket having a flat portion 292 mounted to the shower wall 400 and an extending portion 294 supporting the base portion 285 of the secondary support brace 280 to provide additional angular support for the lowered shower seat to accept more weight on the shower seat than the first embodiment.

The seat portion 270 of the second embodiment is also a rigid water impermeable material attached to an upper surface 234 of the support frame 230. The seat portion 270 is attached to the support frame 230 which will not to impede the raising or lowering of the shower seat, also allowing the seat portion 270 to rest flush against the shower wall 400 in a raised position. The seat portion 270 may include padding for the comfort of the user, and may also include holes to allow water to drain through the seat portion during and after bathing.

The torsion spring 250 is biased between the vertical arm 226 of the L-bracket 220 and a lower surface 272 of the seat portion 270, as indicated in FIG. 5. This torsion spring 250 provides an upward force to assist in raising the shower seat, and also provides a downward resistance when lowering the shower seat. This torsion spring 250 should be of sufficient tension as to reduce the amount of force required to raise and lower the shower seat at less than 5 lbf, or 22 N.

A third embodiment, shown in FIGS. 7–9*b*, also includes two wall mounting brackets 310, a torsion spring 350, a support frame 330 connected to a seat portion 370, the support frame 330 pivotally attached to the wall mounting brackets 310 and also includes a pivotal secondary support brace 380, pivotally connected to the support frame 330, the secondary support brace 380 slidably engaging a support leg bracket 390, also mounted to the shower wall 400 below the wall mounting brackets 310, while the torsion spring 350 applies a bias force between the wall mounting bracket 310 and the seat portion 370. The main difference between the second and third embodiments lies within the wall mounting brackets 210, 310 and the connection between the wall mounting brackets 210, 310 and the support frame 230, 330.

Each of the two wall mounting brackets 310 of the third embodiment include a base plate 312 having two horizontally oriented holes 314 in each base plate. Attached to each base plate 312 are a first side support plate 320 and a second side support plate 321 extending from the base plate 312, with the first side support plate 320 having a tubular cylindrical side extension 322 having a central channel 324, upon which the torsion spring 350 is affixed. Pivot holes are placed through the first and second side support plates 320, 321, aligned with the central channel 324, allowing for the insertion of a threaded bolt 325 and lock nut 326 to connect the support frame 330 to the wall mounting brackets 310. The torsion spring 350 includes an anchor leg 352 extending from a central coil 354, and an extension leg 356. The central coil 354 is positioned to wrap around the side extension 322, with the anchor leg 352 extending downward and the extension leg 356 extending upward, indicated in FIG. 8. An anchor peg 328, indicated in FIGS. 9*a* and 9*b*, is located on the first side support plate 320, engaging the anchor leg 352 to arrest movement of the anchor leg 352 towards the shower wall 400 when the wall mounting bracket 310 is secured to the shower wall 400 and to secure and hold the torsion spring 350 on the side extension 322. The first side support bracket 320 is attached between the two holes 314 on the base plate 312 while the second side support bracket 321 is attached on an outer edge 313 of the base plate 312.

The support frame 330 of the third embodiment includes two side brackets 340 connected together by a front cross connecting bracket 332 and a rear cross connecting bracket 336, as shown in FIG. 8 of the drawings. The side brackets 340 include extension arms 342 having vertically oriented holes through which the threaded bolts 325 may extend, the extension arms 342 captured between the side support plates 320, 321, holding the support frame 330 in pivotal attachment to the wall mounting brackets 310. The secondary support brace 380 is U-shaped, with two legs 382 having a first end 384 connecting to a perpendicular tubular portion 386 having a transverse channel 387, and a second end 388 connected to a base portion 385. Ideally, this secondary support brace 380 is also a single piece of bent metal with the tubular portion 386 welded onto the first ends 384. The front cross connecting bracket 332 is pivotally engaged within the tubular portions 386 of the secondary support brace 380. The support leg bracket 390, also mounted to the shower wall 400 below the wall mounting brackets 310, is a triangular projecting bracket having a flat portion 392 mounted to the shower wall 400 and an extending portion 394 supporting the base portion 385 of the secondary support brace 380 to provide additional angular support for the lowered shower seat to accept more weight on the shower seat than the first and embodiments.

The seat portion 390 is once again a rigid water impermeable material attached to an upper surface 334 of the support frame 330. The seat portion 390 is attached to the support frame 330 in such manner as to avoid impeding the raising or lowering of the shower seat, also allowing the seat portion 390 to rest flush against the shower wall 400 in a raised position. The seat portion 390 may include padding for the comfort of the user, and may also include some holes to allow water to drain through the seat portion during and after bathing.

The torsion spring 350 is biased between the anchor peg 328 on the first side support plate 320 and a lower surface 372 of the seat portion 370. This torsion spring 350 provides an upward force to assist in raising the shower seat, and also provides a downward resistance when lowering the shower seat. This torsion spring 350 should be of sufficient tension as to reduce the amount of force required to raise and lower the shower seat at less than 5 lbf, or 22 N.

Size and shape of the seat portion, in all three embodiments, may vary according to the shape and size of the user and the shower or bath within which the shower set is installed. Installation may be to a new shower and bath or an existing shower and bath. All components are to be impermeable to water and also non-corrosive. Sharp edges and corners should be avoided in all components and padding may be placed at any location that might be a potential contact point. Other shower and bath accessories, including support bars, may be utilized in conjunction with the shower seat provided that they do not interfere with the raising and lowering of the shower seat.

While the invention has been particularly shown and described with reference to a preferred embodiment thereof, it will be understood by those skilled in the art that changes in form and detail may be made therein without departing from the spirit and scope of the invention.

What is claimed is:

1. A lift assist shower seat attached to a shower wall for persons requiring seating during bathing or shower, the shower seat pivoting between a vertical and horizontal position comprising essentially:

two wall mounting brackets secured to the shower wall, pivotally attaching to a support frame;

at least one torsion spring secured to the wall mounting brackets; and a rigid impermeable seat portion mounted to said support frame, the said at least one torsion spring applying an upward urging force against the seat portion, with said at least one torsion spring further providing assistance to lower the amount of force required to raise and lower the seat portion below 5 lbf wherein each said wall mounting bracket further comprises a central plate having two vertically aligned holes, two side support plates connecting to the central plate, with at least one side support plate including an anchor peg and a tubular cylindrical side extension defining a central channel, both said wall mounting brackets accepting threaded bolts and lock nuts to pivotally secure said support frame to said wall mounting brackets, said at least one torsion spring further comprising an anchor leg extending from a central coil, and an extension leg, said central coil wrapped around said side extension on said wall mounting bracket, with the anchor leg positioned downward and the extension leg positioned upward, said anchor leg engaging said anchor peg; said torsion spring thus supplying a biased force between said wall mounting bracket and said seat portion; said support frame having an upper surface and an underside, said support frame further comprising two side support brackets including extension arms pivotally secured between said side support plates by said threaded bolts, said extension arms further having attached lower block legs mounted to the underside of said extension arms and resting against said central plate when the shower seat is in a horizontal position preventing further lowering of the seat portion from said horizontal position; and said seat portion having a lower surface attached to said upper surface of said support frame.

2. The shower seat as disclosed in claim 1, wherein said wall mounting bracket, said support frame, said threaded bolt, said lock nut and said torsion spring are stainless steel.

* * * * *